United States Patent [19]

Fife

[11] 4,045,069

[45] Aug. 30, 1977

[54] PAINT BUCKET HOLDER

[75] Inventor: Clemens L. Fife, Baton Rouge, La.

[73] Assignee: The Raymond Lee Organization, Inc., New York, N.Y.

[21] Appl. No.: 694,677

[22] Filed: June 10, 1976

[51] Int. Cl.[2] ..... B65D 25/28

[52] U.S. Cl. ..... 294/31.2; 220/94 R; 215/100 A; 16/114 R; 224/45 C

[58] Field of Search ..... 294/31.2; 224/45 R, 224/45 C, 55, 52, 53, 54; 220/94 R; 215/100 A; 16/114 R

[56] References Cited

U.S. PATENT DOCUMENTS

| | | | |
|---|---|---|---|
| 310,641 | 1/1885 | Beatty | 224/52 |
| 925,986 | 6/1909 | Blackburn | 224/53 |
| 1,120,020 | 12/1914 | Bullock | 224/53 |
| 2,774,510 | 12/1956 | Logan | 224/45 C |
| 3,964,126 | 6/1976 | Madsen | 294/31.2 |

*Primary Examiner*—James B. Marbert
*Attorney, Agent, or Firm*—Stephen Wyden

[57] ABSTRACT

An upper strap secured by a buckle around a paint bucket and a lower strap secured around a paint bucket are connected by a pair of vertical straps to which a wooden handle is attached and just below the wooden handle a metal handle is attached, so that the paint bucket may be more easily held and maneuvered.

3 Claims, 4 Drawing Figures

PAINT BUCKET HOLDER

I have invented a new and novel paint bucket holder. My paint bucket holder eliminates the need for the conventional handle found on 1 gallon paint buckets and larger size paint buckets. Furthermore, my paint bucket holder can be removed from one paint bucket and attached to another, therefore reducing the need for paint bucket handles and improving the comfort and efficiency with which a paint bucket can be used. My paint bucket holder can be understood in view of the accompanying figures.

Figure 1:
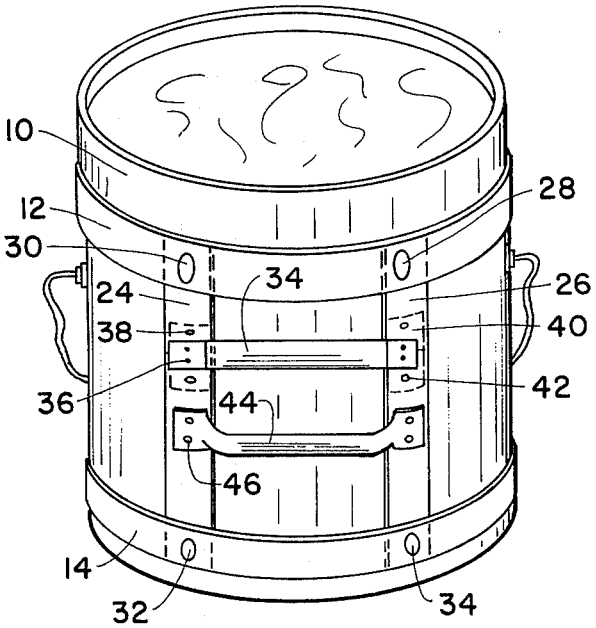
FIG. 1 is a perspective view of a paint bucket holder attached to a paint bucket.
Figure 2:
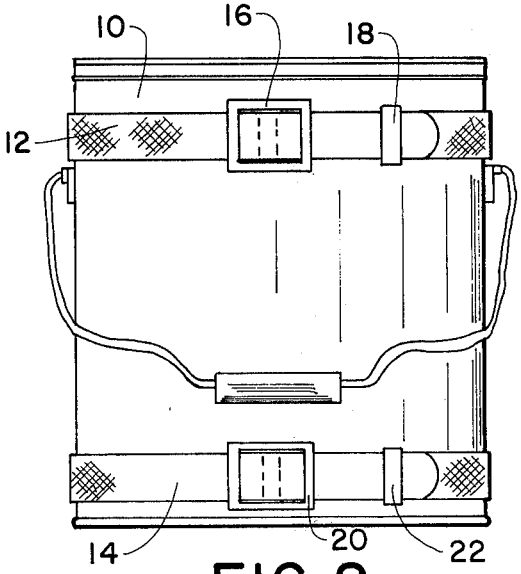
FIG. 2 is a side view of an opposite side of the paint bucket showing the buckle attachment of the paint bucket holder to the paint bucket.
Figure 3:
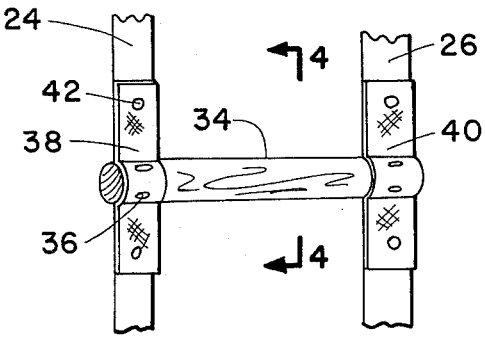
FIG. 3 is a close up of the attachment of the wooden handle to the vertical straps of the paint bucket holder.
Figure 4:
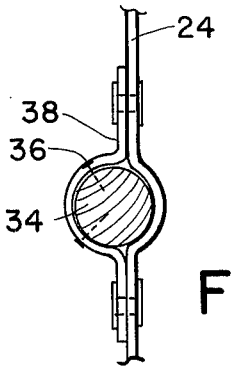
FIG. 4 is a section of FIG. 3 taken along the plane 4—4.

A standard paint bucket 10 can be bound by a pair of straps 12 and 14, which may be preferrably made of canvas material, and the straps may be tightened around the paint bucket 10 by using buckles and belt loops 16 and 18 and 20 and 22. Vertical straps 24 and 26 may be secured to the middle of the straps 12 and 14 by rivets 28, 30, 32, and 34. These vertical straps 24 and 26 may be used to support a wooden handle 34 nailed 36 to a set of connecting strips 38 and 40 which, in turn, are riveted 42 to the vertical straps 24 and 26. A metal handle

44 may be riveted 46 to the vertical straps 24 and 26 just below the wooden handle 34 to provide good control of the paint bucket 10 when tilting and pouring paint from the bucket 10.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A paint bucket holder, comprising:

a strap releaseably secured around an upper portion of a paint bucket by means of a buckle, a second strap releaseably secured around a lower portion of the paint bucket by second buckle, a vertical strap connected between the strap and the second strap, a second vertical strap connected between the strap and the second strap near the vertical strap, a wooden handle attached at each end to a connected strap, each connecting strap secured to one of the vertical straps, and a metal handle secured beneath the wooden handle to the vertical straps.

2. The paint bucket holder of claim 1, wherein the straps are made of a canvas material.

3. The paint bucket holder of claim 2, wherein the attachment of one of the straps to another of the straps is by means of a rivet.

* * * * *